US005563954A

United States Patent [19]

Ono et al.

[11] Patent Number: 5,563,954

[45] Date of Patent: Oct. 8, 1996

[54] MICROPHONE APPARATUS

[75] Inventors: Kiminori Ono, Katano; Satoru Ibaraki, Higashiosaka; Yuji Yamashina, Takatsuki, all of Japan

[73] Assignee: Matsushita Electric Industrial Co., Ltd., Osaka, Japan

[21] Appl. No.: 197,703

[22] Filed: Feb. 17, 1994

[30] Foreign Application Priority Data

Feb. 26, 1993 [JP] Japan ..... 5-063052

[51] Int. Cl.[6] ..... G10K 11/16

[52] U.S. Cl. ..... 381/71

[58] Field of Search ..... 379/390, 388, 379/420; 381/71, 72, 94, 26

[56] References Cited

U.S. PATENT DOCUMENTS 4,769,847 9/1988 Taguchi .

5,233,667 8/1993 Lee ..... 381/26

5,243,661 9/1993 Ohkubo et al. ..... 381/94

FOREIGN PATENT DOCUMENTS 0430513 5/1991 European Pat. Off. .

4028057 2/1992 Germany .

12020530 9/1989 Japan .

*Primary Examiner*—Forester W. Isen

*Attorney, Agent, or Firm*—Wenderoth, Lind & Ponack

[57] ABSTRACT

A reference microphone is disposed close to a primary microphone through an enclosure wall of an appliance incorporating microphones, and a noise generated by mechanical systems and included in an output of the primary microphone is canceled by an adaptive filter. In a smaller hardware scale than a case of mounting a sensor for noise reference directly to a noise source, a noise component can be canceled more effectively depending on changes of noise environments.

2 Claims, 2 Drawing Sheets

MICROPHONE APPARATUS

BACKGROUND OF THE INVENTION

1. Field of the Invention

The present invention relates to a microphone apparatus to be built into an appliance possessing a mechanical system generating noise or mechanical vibration in its enclosure.

2. Description of the Prior Art

In the downsizing trend of appliances, such as video cameras and cassette tape recorders, possessing a recording function, microphones installed in such appliances have been changed from a type projecting from an enclosure of an appliance, to a type built in a small space provided in a part of the enclosure. However, for example, in the case of a video camera, since various mechanical systems are incorporated in its enclosure such as a tape running system for recording and a lens driving system for providing a zooming function, noise or mechanical vibration generated by the mechanical systems are transmitted to a built-in microphone, and a signal-to-noise ratio is significantly lowered when picking up sound.

A microphone apparatus for reducing the noise generated by the mechanical systems incorporated in the appliance by using an adaptive filter has been already proposed (for example, see Japanese Laid-Open Patent Application No. 3-295400). The microphone apparatus comprises a primary microphone, a vibration pickup unit provided in a mechanical system comprising a noise source, and an adaptive signal processing unit for reducing a noise mixed into an audio signal using a detected signal as a reference signal. The thus composed microphone apparatus mimics an impulse response of a transmission path from a vibration source to the primary microphone by the adaptive filter, and a false noise generated by convoluting the impulse response having mimicked a signal detected by the vibration pickup unit is added in opposite phase to an output signal of the primary microphone. The noise generated by the mechanical systems may be classified into two types, that is, noise component radiated into the air and transmitted to the primary microphone as a sound wave, and a vibration noise component coupled to the primary microphone by vibration transmitted through the enclosure, and both are caused by vibration of the mechanical systems. It is therefore possible to reduce the noise component contained in the output signal of the primary microphone, by directly detecting the vibration of the mechanical systems comprising a noise source, and using the detected signal as the reference signal.

In the case of the microphone apparatus mentioned above:

In the appliance possessing a recording function, usually, numerous mechanical parts are mounted at a high density in the enclosure, so a structure in the enclosure is extremely complicated. Therefore, to use vibration of a vibration source remote from the primary microphone directly as the reference signal, it is necessary to extend an impulse response length for mimicking with the adaptive filter, heighten a sampling frequency in order to express complicated transfer characteristics, and increase a number of taps of the adaptive filter.

Moreover, generally, plural vibration sources are present in the enclosure, and in order to suppress the noise corresponding to each of the vibration sources, a number of vibration detecting means and a number of the adaptive signal processing units each equal to a number of the vibration sources should be required.

Because of the above reasons, a large amount of hardware was needed for the adaptive signal processing unit.

SUMMARY OF THE INVENTION

It is hence an object of the present invention to present a microphone apparatus capable of picking up sound with a high signal-to-noise ratio, by canceling the noise generated by the mechanical systems depending on the changes of the noise environments in the enclosure of the appliance incorporating a microphone, using a small amount of hardware To achieve the object, the microphone apparatus of the present invention comprises an enclosure wall provided in an appliance, a primary microphone disposed outside of the enclosure wall for receiving sound from outside of the primary microphone, a reference microphone disposed inside the enclosure wall and adjacent to the primary microphone through the enclosure wall for receiving noise generated by a noise source in the appliance, the reference microphone being disposed away from the noise source, and a signal processing means for processing an output of the primary microphone and an output of the reference microphone and for producing an audio signal. Preferably, the microphone apparatus of the present invention comprises an enclosure wall provided in an appliance, a primary microphone disposed outside the enclosure wall for receiving sound from outside of the primary microphone, a reference microphone disposed inside the enclosure wall and adjacent to the primary microphone through the enclosure wall for receiving a noise generated in the appliance, an estimation circuit for impulse response for sequentially estimating an impulse response of a transmission path from the reference microphone to the primary microphone according to an algorithm of a learning identification method and for producing an estimated impulse response, a finite impulse response (FIR) filter for holding the estimated impulse response as a tap coefficient, an adder for inverting a phase of an output of the FIR filter and adding an inverted output of the FIR filter to an output of the primary microphone, and a speech detection circuit for judging the presence or absence of a desired audio signal from outside of the enclosure wall by using the output of the primary microphone and the output of the reference microphone and for stopping an estimation action of the estimation circuit for impulse response while the desired audio signal is being fed into the primary microphone.

Being thus constituted, in the microphone apparatus of the present invention, since the reference microphone is disposed adjacently to the primary microphone, the impulse response length to be mimicked by the FIR filter is short, and even if a position of a noise source changes, it is possible to always mimic the impulse response optimally by following up a change of the position of the noise source. Therefore, the microphone apparatus of the present invention is capable of effectively decreasing the effects of the noise and vibration generated by the appliance incorporating a microphone, and preventing the signal-to-noise ratio from dropping at the time of picking up sound, in a small hardware configuration.

DESCRIPTION OF THE PREFERRED EMBODIMENTS

Figure 1:
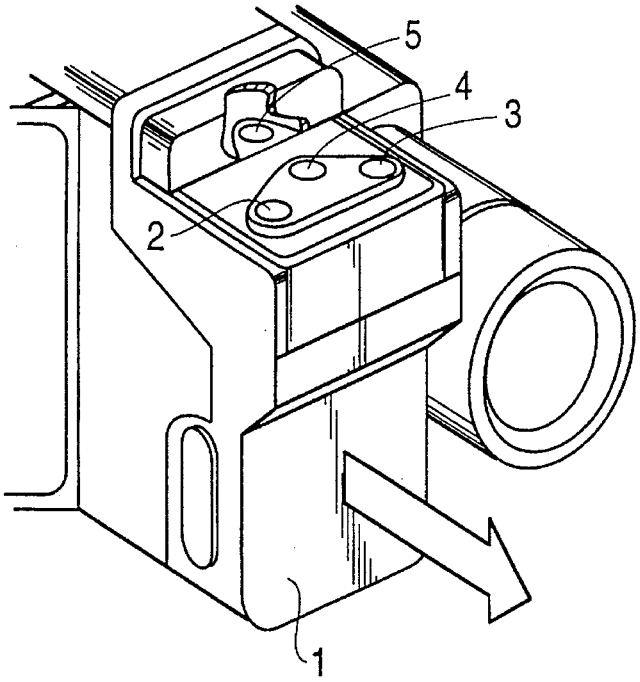
FIG. 1 is a diagram showing a layout of a microphone unit of a microphone apparatus in accordance with an embodiment of the present invention.

An application of the present invention in a small-sized video camera is described below while referring to the drawings.

FIG. 1 is a diagram showing a layout of a microphone unit of a microphone apparatus in accordance with an embodiment of the present invention. In FIG. 1, element 1 is an enclosure of a video camera, and the arrow indicates a front direction of the video camera. Elements 2, 3, and 4 are microphone units composing a primary microphone, and element 5 is an omnidirectional microphone unit to be used as a reference microphone. The omnidirectional microphone unit 5, used as a noise reference, is provided in the enclosure 1 of the video camera, and is disposed at a position adjacent to the primary microphone through an enclosure wall.

Figure 2:
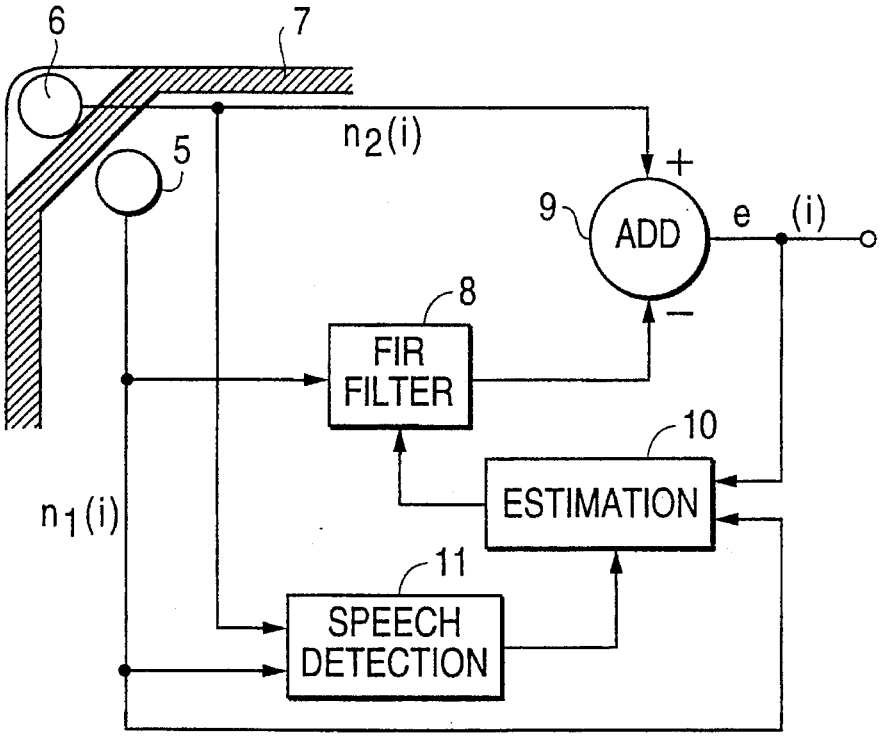
FIG. 2 is a block diagram showing a constitution of a signal processing unit of the microphone apparatus in accordance with the embodiment of the present invention.

FIG. 2 is a block diagram showing a constitution of a signal processing unit of the microphone apparatus of the embodiment. In the block diagram, element 5 is the omnidirectional microphone unit used as a noise reference, numeral 6 is a primary microphone; element 7 is an enclosure wall of the video camera; element 8 is an FIR filter; element 9 is an adder for adding an output of the FIR filter 8 to an output of the primary microphone 6 after inverting a phase of the output of the FIR filter 8; element 10 is an estimation circuit for impulse response for correcting a tap coefficient of the FIR filter 8 according to an algorithm of a learning identification method, and element 11 is a speech detection circuit for judging the presence or absence of a desired audio signal from outside of the enclosure, and for stopping the correction action of the tap coefficient by the estimation circuit 10 for impulse response while the desired audio signal is present.

Figure 3:
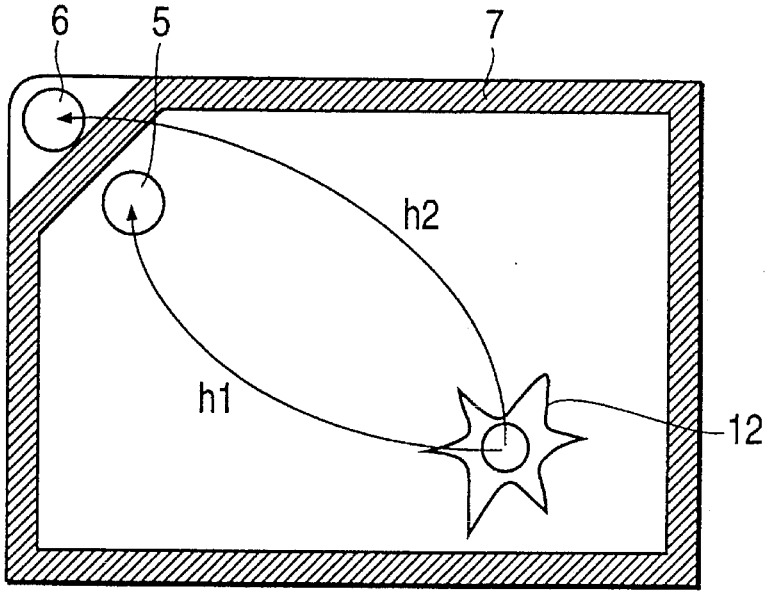
FIG. 3 is a diagram showing positions of microphones and a noise source in the microphone apparatus in accordance with the embodiment of the present invention.

The signal processing unit as shown in FIG. 2 operates as follows. FIG. 3 shows the positions of the microphones and a noise source. In FIG. 3, element, 5 is the omnidirectional microphone unit; element 6 is the primary microphone, and element 7 is the enclosure wall of the video camera. Herein, supposing a noise in a noise source 12 to be $n_0$ (i), the noise at an output end of the omnidirectional microphone unit 5 to be $n_1$ (i), and the noise at an output end of the primary microphone 6 to be $n_2$ (i), they can be expressed as follows.

$$n_1(i)=h_1(i)*n_0(i) \tag{1}$$

$$n_2(i)=h_2(i)*n_0(i) \tag{2}$$

In formulas (1) and (2), $h_1$ (i) and $h_2$ (i) are impulse responses when transferring from the noise source 12 to the omnidirectional microphone unit 5 and the primary microphone 6, respectively, and an operational symbol * represents a convolution. In the absence of the desired audio signal from outside of the enclosure, supposing an output of the adder 9 in FIG. 2 to be e(i), and an impulse response of the FIR filter 8 to be h(i), a following relation $$e(i)=n_2(i)-h(i)*n_1(i) \tag{3}$$

is established. Putting the formulas (1) and (2) into formula (3), a following formula is obtained by z-transform.

$$E(z)=[H_2(z)-H(z)H_1(z)]N(z) \tag{4}$$

Therefore, when a transfer function H(z) of the FIR filter 8 is $$H(z)=\frac{H_2(z)}{H_1(z)}, \tag{5}$$

a noise component derived from the noise source 12 contained in an output signal of the primary microphone 6 is completely removed. The estimation circuit 10 for impulse response in FIG. 2 sequentially corrects the tap coefficients so as to converge the transfer function of the FIR filter into the transfer function shown in formula (5), according to the algorithm of the learning identification method. A method of calculating the tap coefficient by the learning identification method is shown in formula (6).

$$h_j(i+1)=h_j(i)+a\frac{e(i)n_1(i-j)}{\sum_{j=0}^{N-1} n_1^2(i-j)} \tag{6}$$

Figure 4:
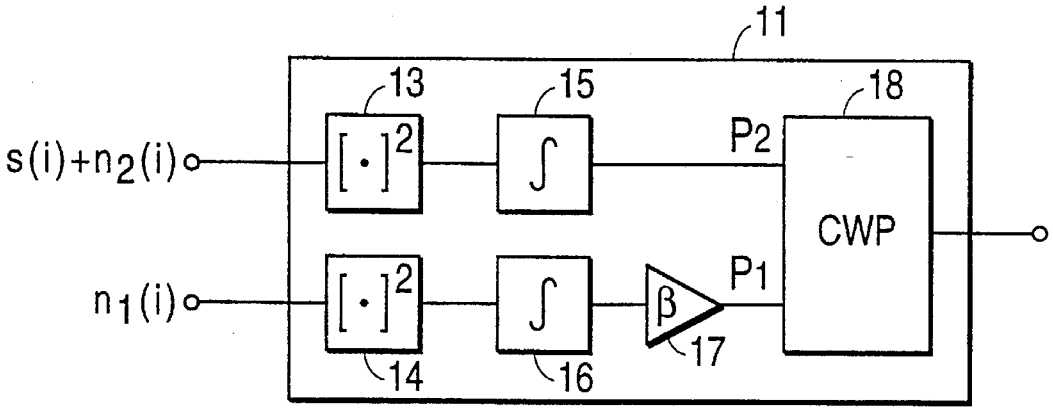
FIG. 4 Is a diagram showing a constitution of a speech detection circuit of the microphone apparatus in accordance with the embodiment of the present invention.

In the formula (6). N refers to a number of taps of the FIR filter 8, $h_j$ (i) is the j–th (j is 0 to N–1) tap coefficient at time i, and $\alpha$ is a step size. To ensure stability of the signal processing unit, the value of $\alpha$ should be within $0<\alpha\leqq 1$. In noise suppression using the adaptive filter, when the tap coefficient is corrected in a state of mixture of a signal uncorrelated with a noise to be suppressed, an error is caused in estimation of the impulse response, and therefore, usually, the presence or absence of the signal uncorrelated with the noise to be suppressed is always judged, and it is necessary to fix the tap coefficient if the signal uncorrelated with the noise to be suppressed exists. A constitution of the speech detection circuit 11 of the microphone apparatus is shown in FIG. 4. An output signal of the primary microphone 6 is the sum of a desired audio signal s(i) and the noise $n_2$ (i), and the omnidirectional microphone unit 5 is supposed to be free from crosstalk of the desired audio signal. An output of the primary microphone 6 and an output of the omnidirectional unit 5 are converted to powers in power calculating units 13 and 14, and are integrated by integrators 15 and 16 having proper time constants. An output of an integrator 16 is further multiplied by a proper constant $\beta$ in a multiplier 17, and an output $P_2$ of the multiplier 17 and an output $P_1$ of the integrating unit 15 are compared. If $P_2\geqq P_1$, the speech detection circuit 11 judges that the desired audio signal is entered, and correction of the tap coefficient by the estimation circuit 10 for impulse response is stopped, and if $P_2<P_1$, correction of the tap coefficient is executed according to the formula (6).

In this way, in the microphone apparatus of the present invention, since the reference microphone is disposed at a position adjacent to the primary microphone through the enclosure wall, as compared with a case of installing a sensor directly on the noise source for obtaining the reference signal, a length of the impulse response to be mimicked by the adaptive filter is shorter, and hence the amount of hardware may be smaller, while it is easy to mount the reference microphone. In addition, in the microphone apparatus of the present invention, since it is possible to follow up position changes of the noise source by one reference microphone, it is possible to realize suppression of a noise depending on changes of noise environments in the enclosure in a simple constitution.

What is claimed is:

1. A microphone apparatus comprising: an enclosure wall provided in an appliance; a primary microphone disposed outside the enclosure wall for receiving a sound from outside of the primary microphone; a reference microphone disposed inside the enclosure wall and adjacent to the primary microphone through the enclosure wall for receiving a noise generated by a noise source in the appliance, said reference microphone being disposed away from said noise source; and a signal processing means for processing an output of the primary microphone and an output of the reference microphone and for producing an audio signal.

2. A microphone apparatus comprising: an enclosure wall provided in an appliance; a primary microphone disposed outside the enclosure wall for receiving a sound from outside of the primary microphone; a reference microphone disposed inside the enclosure wall and adjacent to the primary microphone through the enclosure wall for receiving a noise generated by a noise source in the appliance, said reference microphone being disposed away from said noise source; an estimation circuit for impulse response for sequentially estimating an impulse response of a transmission path from the reference microphone to the primary microphone according to an algorithm of a learning identification method and for producing an estimated impulse response; a finite impulse response (FIR) filter for holding the estimated impulse response as a tap coefficient; an adder for inverting a phase of an output of the FIR filter and adding an inverted output of the FIR filter to an output of the primary microphone; and a speech detection circuit for judging presence or absence of a desired audio signal from outside of the enclosure wall by using the output of the primary microphone and the output of the reference microphone and for stopping an estimation action of the estimation circuit for impulse response while the desired audio signal is being fed into the primary microphone.

* * * * *